US007457557B2

(12) United States Patent
Roof et al.

(10) Patent No.: US 7,457,557 B2
(45) Date of Patent: Nov. 25, 2008

(54) HIGH PRECISION-HEATING AND FUSING APPARATUS

(75) Inventors: Bryan J. Roof, Fairport, NY (US); Gerald A. Domoto, Briarcliff Manor, NY (US)

(73) Assignee: Xerox Corporation, Norwalk, CT (US)

( * ) Notice: Subject to any disclaimer, the term of this patent is extended or adjusted under 35 U.S.C. 154(b) by 286 days.

(21) Appl. No.: 11/398,147

(22) Filed: Apr. 5, 2006

(65) Prior Publication Data

US 2007/0237536 A1 Oct. 11, 2007

(51) Int. Cl.
*G03G 15/20* (2006.01)

(52) U.S. Cl. ..... 399/69; 399/334

(58) Field of Classification Search ..... 399/38, 399/67, 69, 107, 122, 320, 328, 333; 216/219
See application file for complete search history.

(56) References Cited

U.S. PATENT DOCUMENTS 6,301,454 B1 * 10/2001 Nishida et al. ..... 399/69
6,407,366 B2 6/2002 Yoshimura
6,734,397 B2 5/2004 Kato et al.
6,862,424 B2 * 3/2005 Matsunaka et al. ..... 399/333
6,882,804 B2 * 4/2005 Eskey ..... 399/45
7,027,749 B2 * 4/2006 Kamei ..... 399/69

* cited by examiner

*Primary Examiner*—Hoan H Tran
(74) *Attorney, Agent, or Firm*—Tallam I. Nguti

(57) ABSTRACT

A high precision-heat fusing device is provided for heating unfused toner images in an electrostatographic reproducing machine. The high precision-heating and fusing apparatus includes (a) an endless rotatable shell defining an interior and having an exterior surface, a first end, a second end, and an axis for rotation; (b) at least six heating elements each having an end-to-end length and being selectively activatable, and arranged end-to-end in series and parallel to the axis of rotation; (c) at least six temperature sensors for sensing a temperature of the exterior surface at axially spaced apart points; and (d) a controller connected to the at least six heating elements and to the at least six temperature sensors for precisely sensing and controlling the temperature of the exterior surface at each of the axially spaced apart points.

13 Claims, 4 Drawing Sheets

HIGH PRECISION-HEATING AND FUSING APPARATUS

The present invention relates to an electrostatographic reproducing machine and, more particularly, to such a machine having a high precision-heating and fusing apparatus.

BACKGROUND OF THE DISCLOSURE

One type of electrostatographic reproducing machine is a xerographic copier or printer. In a typical xerographic copier or printer, a photoreceptor surface, for example that of a drum, is generally arranged to move in an endless path through the various processing stations of the xerographic process. As in most xerographic machines, a light image of an original document is projected or scanned onto a uniformly charged surface of a photoreceptor to form an electrostatic latent image thereon. Thereafter, the latent image is developed with an oppositely charged powdered developing material called toner to form a toner image corresponding to the latent image on the photoreceptor surface. When the photoreceptor surface is reusable, the toner image is then electrostatically transferred to a recording medium, such as paper, and the surface of the photoreceptor is cleaned and prepared to be used once again for the reproduction of a copy of an original. The paper with the powdered toner thereon in imagewise configuration is separated from the photoreceptor and moved through a fuser apparatus to permanently fix or fuse the toner image to the paper.

Typically, a fuser apparatus of the type provides a combination of heat and pressure to fix the toner image on the paper. The basic architecture of a fuser apparatus is well known. Essentially, it comprises a pressure roll that rolls against a rotatable heated fuser roll to form a nip therebetween. A sheet of paper carrying an unfused or powder toner image is passed through the nip. The side of the paper having the unfused or powder toner image typically faces the fuser roll, which is often supplied with a heat source, such as a resistance heater, at the core thereof. The combination of heat from the fuser roll and pressure between the fuser roll and the pressure roll fuses the toner image to the paper, and once the fused toner cools, the image is permanently fixed to the paper.

Examples of conventional fusing systems can be found in U.S. Pat. No. 6,407,366 issued Jun. 18, 2002 and entitled "Image heating apparatus having a plurality of heat generating elements". For the purpose of having only a small number of semiconductor switching elements, this reference discloses long heating elements that are treated similar to lamps in that they are multiple long elements parallel to the long axis, and turned on and off like lamps depending on whether the job runs on letter size or legal size sheets.

U.S. Pat. No. 6,734,397 issued May 11, 2004 and entitled "Heater having at least one cycle path resistor and image heating apparatus therein" discloses a heater, or an image heating apparatus including a heater that has a substrate, heat generating resistors formed at least in a cycle path on the substrate, and current supply electrodes provided at electrical ends of the heat generating resistors, wherein plural heat generating resistors are connected in parallel to at least one of the current supply electrodes. Thus there can be obtained a heater having excellent heat generating characteristics even in a compact dimension and an image heating apparatus utilizing such heater.

In most fusing systems in use today, such as those disclosed in the references cited above, the fusing system ordinarily suffers from lack of precise axial thermal uniformity, particularly in fusing systems being required to run at relatively higher and higher throughput speeds. Such a lack of precise axial thermal uniformity is particularly true when large jobs requiring the reproduction of many copies of a non-uniform developer mass per unit area (dma) are run through such fusing systems. This is a problem because on each sheet being fused by the system, image areas with higher densities of developed toner, or higher (dma) developer mass, tend to draw relatively more heat from the heated fuser member of the fusing system than areas with less (dma) developer mass, or less developed toner densities. The undesirable result or consequence is a fusing system with relatively hot and relatively cooler spots, which then cause subsequent inconsistent fusing and poor image quality.

Additionally, there are toner documents that may be created with regular toner in most of the document areas, and MICR (magnetic image character recognition) toner only in a few areas of the document. MICR toner ordinarily requires higher fusing temperatures than ordinary toner. Conventional fusing devices and apparatus ordinarily can only fuse at a single temperature.

SUMMARY

In accordance with the present disclosure, there is provided a high precision-heating and fusing apparatus for heating unfused toner images in an electrostatographic reproducing machine. The high precision-heating and fusing apparatus includes (a) an endless rotatable shell defining an interior and having an exterior surface, a first end, a second end, and an axis for rotation; (b) at least six heating elements each having an end-to-end length and being selectively activatable, and arranged end-to-end in series and parallel to the axis of rotation points for enabling fusing of images formed with regular toner in most of the document areas, and with a higher fusing temperature requiring toner such as MICR (magnetic image character recognition) toner only in a few areas of the document; (c) at least six temperature sensors for sensing a temperature of the exterior surface at axially spaced apart points; and (d) a controller connected to the plural number of heating elements and to the plural number of temperature sensors for precisely sensing and controlling the temperature of the exterior surface at each of the axially spaced apart points for enabling fusing of images formed with regular toner in most of the document areas, and with a higher fusing temperature requiring toner such as MICR (magnetic image character recognition) toner only in a few areas of the document.

BRIEF DESCRIPTION OF THE DRAWINGS

In the detailed description below, reference is made to the drawings, in which.

DETAILED DESCRIPTION

Figure 1:
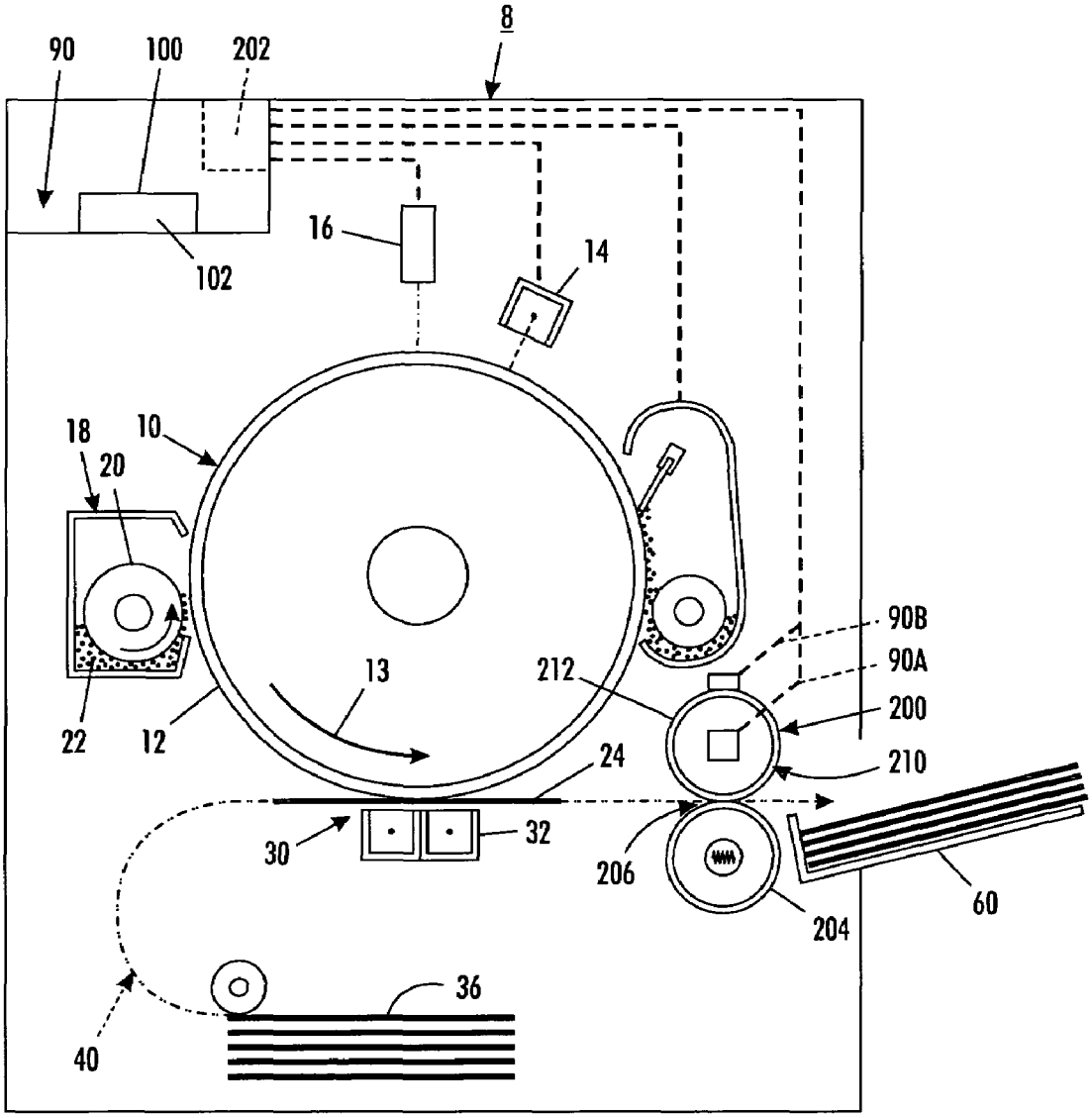
FIG. 1 is an elevational view showing relevant elements of an exemplary toner imaging electrostatographic machine including a first embodiment of the high precision-heating apparatus of the present disclosure.

Referring now to FIG. 1, it is a simplified elevational view showing relevant elements of an electrostatographic or toner-imaging machine 8. As is well known, a charge receptor or photoreceptor 10 having an imageable surface 12 and rotatable in a direction 13 is uniformly charged by a charging device 14 and image-wise exposed by an exposure device 16 to form an electrostatic latent image on the surface 12. The latent image is thereafter developed by a development apparatus 18 that for example includes a developer roll 20 for applying a supply of charged toner particles 22 to such latent image. The developer roll 20 may be of any of various designs such as a magnetic brush roll or donor roll, as is familiar in the art. The charged toner particles 22 adhere to appropriately charged areas of the latent image. The surface of photoreceptor 10 then moves, as shown by the arrow 13, to a transfer zone generally indicated as 30. Simultaneously, a print sheet 34 on which a desired image is to be printed is drawn from a sheet supply stack 36 and conveyed along a sheet path 40 to the transfer zone 30.

At the transfer zone 30, the print sheet 34 is brought into contact or at least proximity with a surface 12 of photoreceptor 10, which at this point is carrying toner particles thereon. A corotron or other charge source 32 at transfer zone 30 causes the toner image on photoreceptor 10 to be electrostatically transferred to the print sheet 34. The print sheet 34 is then forwarded to subsequent stations, as is familiar in the art, including the fusing station having a high precision-heating and fusing apparatus 50 of the present disclosure, and then to an output tray 60. Following such transfer of a toner image from the surface 12 to the print sheet 34, any residual toner particles remaining on the surface 12 are removed by a toner image bearing surface cleaning apparatus 44 including a cleaning blade 46 for example.

Referring now to FIG. 1, it is a simplified elevational view showing relevant elements of an electrostatographic or toner-imaging machine 8. As is well known, a charge receptor or photoreceptor 10 having an imageable surface 12 and rotatable in a direction 13 is uniformly charged by a charging device 14 and image-wise exposed by an exposure device 16 to form an electrostatic latent image on the surface 12. The latent image is thereafter developed by a development apparatus 18 that for example includes a developer roll 20 for applying a supply of charged toner particles 22 to such latent image. The developer roll 20 may be of any of various designs such as a magnetic brush roll or donor roll, as is familiar in the art. The charged toner particles 22 adhere to appropriately charged areas of the latent image. The surface of photoreceptor 10 then moves, as shown by the arrow 13, to a transfer zone generally indicated as 30. Simultaneously, a print sheet 34 on which a desired image is to be printed is drawn from a sheet supply stack 36 and conveyed along a sheet path 40 to the transfer zone 30.

At the transfer zone 30, the print sheet 34 is brought into contact or at least proximity with a surface 12 of photoreceptor 10, which at this point is carrying toner particles thereon. A corotron or other charge source 32 at transfer zone 30 causes the toner image on photoreceptor 10 to be electrostatically transferred to the print sheet 34. The print sheet 34 is then forwarded to subsequent stations, as is familiar in the art, including the fusing station having a high precision-heating and fusing apparatus 50 of the present disclosure, and then to an output tray 60. Following such transfer of a toner image from the surface 12 to the print sheet 34, any residual toner particles remaining on the surface 12 are removed by a toner image bearing surface cleaning apparatus 44 including a cleaning blade 46 for example.

As further shown, the reproduction machine 8 includes a controller or electronic control subsystem (ESS), indicated generally by reference numeral 90 which is preferably a programmable, self-contained, dedicated mini-computer having a central processor unit (CPU), electronic storage 102, and a display or user interface (UI) 100. The ESS 90, with the help of sensors, a look up table 202 and connections, can read, capture, prepare and process image data such as pixel counts of toner images being produced and fused. As such, it is the main control system for components and other subsystems of machine 8 including the high precision-heating and fusing apparatus 200 and precision-heat fusing device 210 of the present disclosure.

Referring now to FIGS. 1-5, the high precision-heating and fusing apparatus 200 and the high precision-heat fusing device 210, 210' of the present disclosure are illustrated in detail, and are suitable for uniform and quality heating of unfused toner images 213 in the electrostatographic reproducing machine 8, including for example a toner image having a higher fusing temperature MICR toner only in a particular area, such as an edge area of the image for example. In such a case, the corresponding elements can be selectively controlled, per the present disclosure, at a relatively different and desired higher temperature.

As illustrated, the high precision-heating and fusing apparatus 200 includes a rotatable pressure member 204 that is mounted forming a fusing nip 206 with the high precision-heat fusing device 210 of the present disclosure. A copy sheets 24 carrying an unfused toner image 213 thereon can thus be fed through the fusing nip 206 for high quality fusing.

As further illustrated, the high precision-heat fusing device 210, 210' comprises (a) an endless rotatable shell 212, 212' defining an interior 214 and having a first end 216, a second end 218, and an axis A1 for rotation; and (b) a plural number of heating elements 220, 220' each having an end-to-end length Li and being selectively activatable, and the plural number of heating elements 220 being arranged end-to-end in series in a first embodiment 210, or in a staggered, overlapping ends, (FIG. 4) manner axially in a second embodiment 210', within the interior 214, for precisely controlling axial temperature variations in the endless rotatable shell 212, 212'.

As also shown, the high precision-heat fusing device 210 may further include (a) a plural number of temperature sensors 230 for each sensing a temperature of a portion of the exterior surface 215 at axially spaced apart points of the endless rotatable shell 212, 212', and (b) a controller 90 connected to each of the plural number of heating elements 220, 220' and to each of the plural number of temperature sensors 230, for precisely sensing and controlling the temperature Ti of the exterior surface 215 at each of the axially spaced apart points.

Figure 2:
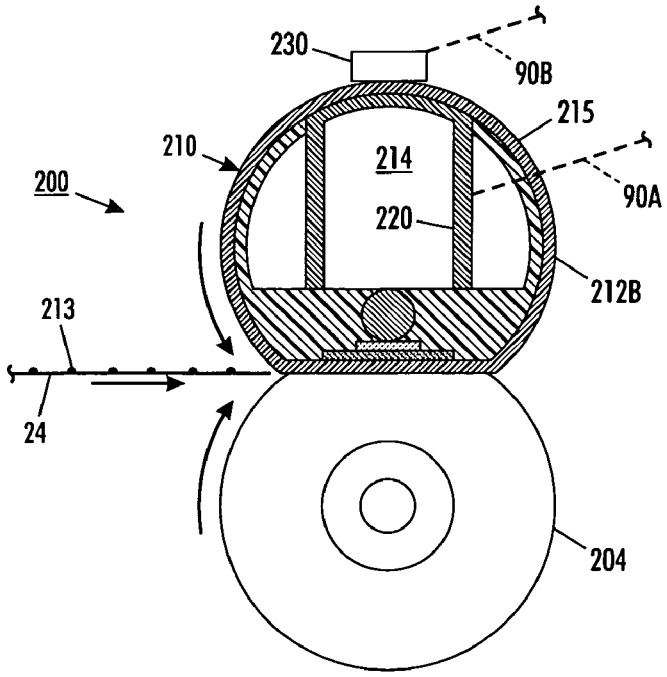
FIG. 2 is an enlarged schematic end view of the first embodiment of the high precision-heating apparatus of FIG. 1.
Figure 3:
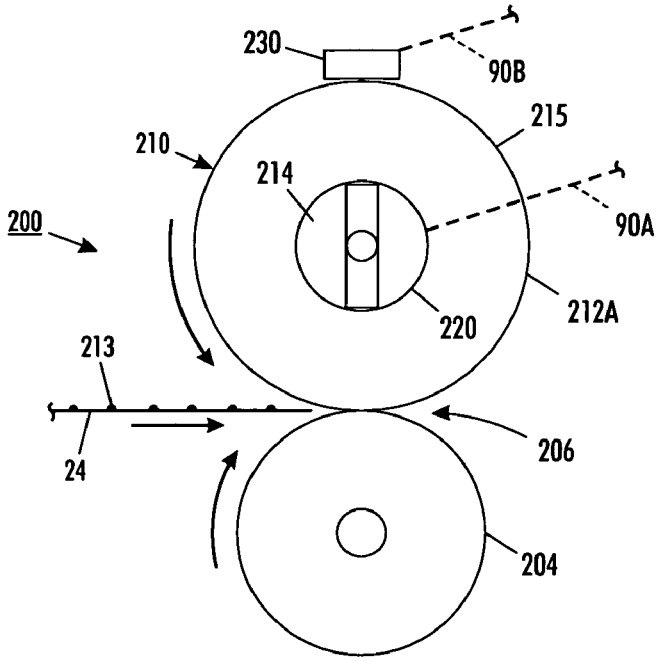
FIG. 3 is an enlarged schematic end view of a second embodiment of the high precision-heating apparatus of FIG. 1.
Figure 4:
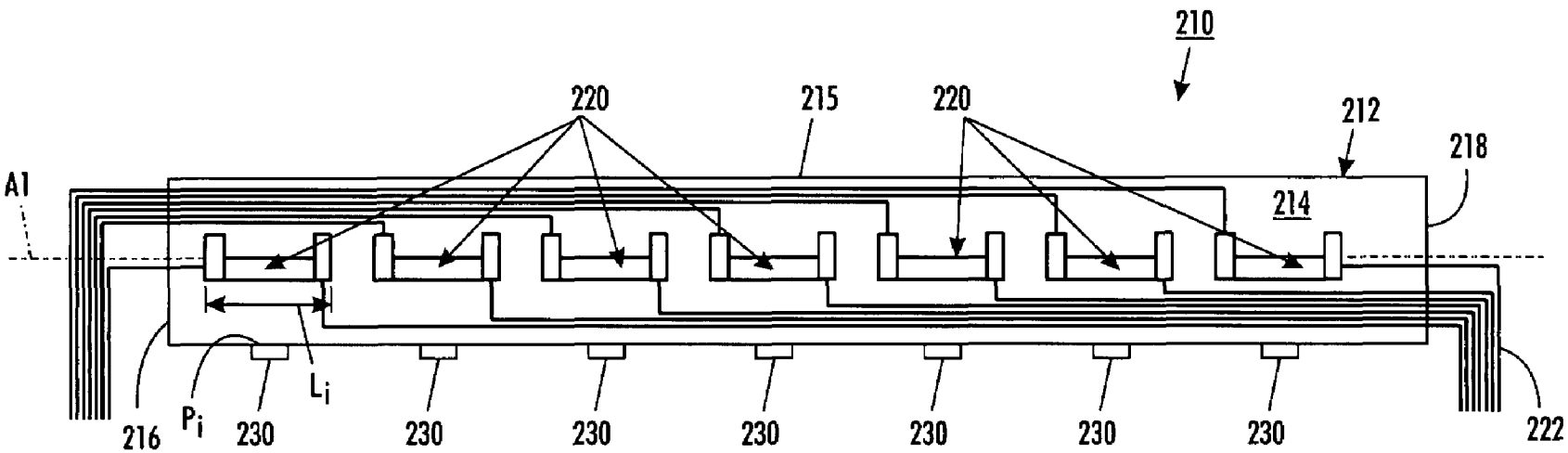
FIG. 4 is an enlarged schematic side view of the high precision-heating apparatus showing an end-to-end series arrangement of the heating element in accordance with the present disclosure.
Figure 5:
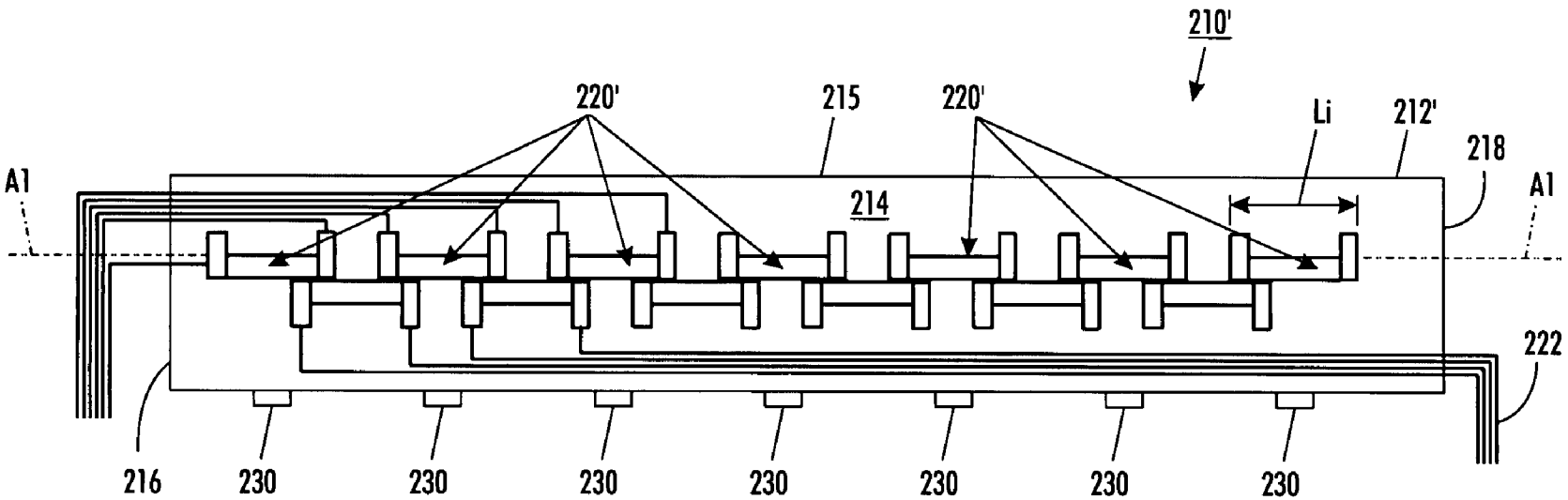
FIG. 5 is an enlarged schematic side view of a first embodiment of the high precision-heating apparatus showing a staggered axial arrangement of the heating element in accordance with the present disclosure.

In a third embodiment, the endless rotatable shell 212, 212' as shown in FIG. 3 may comprise a rigid heat conductive roller having a rigid shell 212A, and in another embodiment as shown in FIG. 2, it may comprise a thin flexible heat conductive belt 212B. The plural number heating elements 220, 220' for example can be any suitable number greater or more than 2, or as shown more than 6 heating elements for enabling fusing of images formed with regular toner in most of the document areas, and with a higher fusing temperature requiring toner such as MICR (magnetic image character recognition) toner only in a few areas of the document as discussed above in paragraph, and thus will include an equivalent number (6) of temperature sensors 230. Each heating element 220, 220' for example can be a ceramic heater connected separately by means 222 as illustrated to an electrical power source (not shown).

By using segmented ceramic heaters or heating elements 220, 220', and by placing them in a series end-to-end, or staggered in the axial direction A1 as shown, within the rotatable shell or roller 212A, 212B, one can selectively activate each segment or heating element 220, 220' by itself, and thus actively control and adjust the individual and thus the overall temperature profile of the fusing device 210, 210' during job runs through the fusing apparatus 200. Different temperature profiles for different types of sheets and for certain types of jobs can be made available in the look-up table 202 within the controller 90 to be used for such control.

As can be seen, there has been provided a high precision-heating and fusing apparatus for heating unfused toner images in an electrostatographic reproducing machine. The high precision-heating and fusing apparatus includes (a) an endless rotatable shell defining an interior and having an exterior surface, a first end, a second end, and an axis for rotation; (b) at least six heating elements each having an end-to-end length and being selectively activatable, and arranged end-to-end in series and parallel to the axis of rotation points for enabling fusing of images formed with regular toner in most of the document areas, and with a higher fusing temperature requiring toner such as MICR (magnetic image character recognition) toner only in a few areas of the document; (c) at least six temperature sensors for sensing a temperature of the exterior surface at axially spaced apart points; and (d) a controller connected to the plural number of heating elements and to the plural number of temperature sensors for precisely sensing and controlling the temperature of the exterior surface at each of the axially spaced apart points for enabling fusing of images formed with regular toner in most of the document areas, and with a higher fusing temperature requiring toner such as MICR (magnetic image character recognition) toner only in a few areas of the document.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A high precision-heat fusing device for heating unfused toner images in an electrostatographic reproducing machine, the high precision-heat fusing device comprising:

(a) an endless rotatable shell defining an interior and having a first end, a second end, and an axis for rotation; and (b) at least six heating elements each having an end-to-end length and being selectively activatable for enabling fusing of images formed with regular toner in most of the document areas, and with a higher fusing temperature requiring toner such as MICR (magnetic image character recognition) toner only in a few areas of the document; said at least six heating elements being arranged end-to-end in series within said interior, for precisely controlling axial temperatures at spaced apart points in said endless rotatable shell.

2. A high precision-heat fusing device for heating unfused toner images in an electrostatographic reproducing machine, the high precision-heat fusing device comprising:

(a) an endless rotatable shell defining an interior and having a first end, a second end, and an axis for rotation; and (b) at least six heating elements each having an end-to-end length and being selectively activatable for enabling fusing of images formed with regular toner in most of the document areas, and with a higher fusing temperature requiring toner such as MICR (magnetic image character recognition) toner only in a few areas of the document;, said at least six heating elements being arranged in an overlapping ends manner along said axis of rotation within said interior, for precisely controlling axial temperatures at spaced apart points in said endless rotatable shell.

3. A high precision-heat fusing device for heating unfused toner images in an electrostatographic reproducing machine, the high precision-heat fusing device comprising:

(a) an endless rotatable shell defining an interior and having an exterior surface, a first end, a second end, and an axis for rotation;

(b) at least six equal end-to-end length heating elements arranged along said axis of rotation for enabling fusing of images formed with regular toner in most of the document areas, and with a higher fusing temperature requiring toner such as MICR (magnetic image character recognition) toner only in a few areas of the document;

(c) at least six temperature sensors for sensing a temperature of said exterior surface at axially space points; and (d) a controller connected to said at least six equal end-to-end length heating elements and to said at least six temperature sensors for precisely sensing and controlling said temperature of said exterior surface at each of said axially spaced apart points for enabling fusing of images formed with regular toner in most of the document areas, and with a higher fusing temperature requiring toner such as MICR (magnetic image character recognition) toner only in a few areas of the document.

4. The high precision-heat fusing device of claim 3, wherein said endless rotatable shell comprises a rigid heat conductive shell.

5. The high precision-heat fusing device of claim 3, wherein said endless rotatable shell comprises a thin flexible heat conductive belt.

6. The high precision-heat fusing device of claim 3, wherein said at least six heating elements each comprises a ceramic heater.

7. A high precision-heating and fusing apparatus for heating unfused toner images in an electrostatographic reproducing machine, the high precision-heating and fusing apparatus comprising:

(a) a movable pressure member; and (b) a movable heated fusing device forming a fusing nip with said movable pressure member for receiving, heating and fusing sheets carrying toner images, said movable heated fusing device including:

(i) an endless rotatable shell defining an interior and having an exterior surface, a first end, a second end, and an axis for rotation;

(ii) at least six equal end-to-end length heating elements arranged along said axis of rotation for enabling fusing of images formed with regular toner in most of the document areas, and with a higher fusing temperature requiring toner such as MICR (magnetic image character recognition) toner only in a few areas of the document;

(iii) at least six temperature sensors for sensing a temperature of said exterior surface at axially space points; and (iv) a controller connected to said at least six equal end-to-end length heating elements and to said at least six temperature sensors for precisely sensing and controlling said temperature of said exterior surface at each of said axially space points.

8. The high precision-heating and fusing apparatus of claim 6, wherein said endless rotatable shell comprises a rigid heat conductive shell.

9. The high precision-heating and fusing apparatus of claim 7, wherein said endless rotatable shell comprises a thin flexible heat conductive belt.

10. An electrostatographic reproduction machine comprising:

(a) a moveable imaging member including an imaging surface;

(b) latent imaging means for forming a latent electrostatic toner image on said imaging surface of said moveable imaging member;

(c) a development apparatus mounted adjacent a path of movement of said moveable imaging member for developing said latent electrostatic image on said imaging surface into a toner image;

(d) a transfer station for transferring said toner image from said imaging surface onto an image-carrying substrate; and (e) a high precision-heating and fusing apparatus for heating unfused toner, the high precision-heating and fusing apparatus including a movable heated fusing device forming a fusing nip with a movable pressure member for receiving, heating and fusing sheets carrying toner images, said movable heated fusing device having:

(i) an endless rotatable shell defining an interior and having an exterior surface, a first end, a second end, and an axis for rotation;

(ii) at least six equal end-to-end length heating elements arranged end-to-end in series and parallel to said axis of rotation for enabling fusing of images formed with regular toner in most of the document areas, and with a higher fusing temperature requiring toner such as MICR (magnetic image character recognition) toner only in a few areas of the document; and (iii) at least six temperature sensors for sensing a temperature of said exterior surface at axially spaced apart points; and (f) a controller for controlling functions and operations of the machine including precisely sensing and controlling said temperature of said exterior surface at each of said axially space points.

11. The electrostatographic reproduction machine of claim 10, wherein said at least six equal end-to-end length heating elements each comprises a ceramic heater.

12. The electrostatographic reproduction machine of claim 10, wherein said endless rotatable shell comprises a rigid heat conductive shell.

13. The electrostatographic reproduction machine of claim 10, wherein said endless rotatable shell comprises a thin flexible heat conductive belt.

* * * * *